US006909435B2

(12) United States Patent
Willis

(10) Patent No.: US 6,909,435 B2
(45) **Date of Patent: *Jun. 21, 2005**

(54) REDUCTION OF GAMMA CORRECTION CONTOURING IN LIQUID CRYSTAL ON SILICON (LCOS) DISPLAYS

(75) Inventor: Donald Henry Willis, Indianapolis, IN (US)

(73) Assignee: Thomson Licensing S.A., Boulogne-Billancourt (FR)

( * ) Notice: Subject to any disclaimer, the term of this patent is extended or adjusted under 35 U.S.C. 154(b) by 92 days.

This patent is subject to a terminal disclaimer.

(21) Appl. No.: 09/964,125

(22) Filed: Sep. 26, 2001

(65) Prior Publication Data

US 2002/0075215 A1 Jun. 20, 2002

Related U.S. Application Data

(60) Provisional application No. 60/256,805, filed on Dec. 20, 2000.

(51) Int. Cl.[7] ..... G09G 5/02

(52) U.S. Cl. ..... 345/596; 345/597; 345/601; 345/602

(58) Field of Search ..... 345/589, 590, 345/596–599, 601–602; 382/274, 275

(56) References Cited

U.S. PATENT DOCUMENTS 4,364,084 A * 12/1982 Akimoto et al. ..... 358/506
5,309,526 A * 5/1994 Pappas et al. ..... 382/237
5,398,297 A * 3/1995 Clark et al. ..... 358/1.9
5,553,200 A * 9/1996 Accad ..... 358/1.9
5,664,080 A * 9/1997 Lucas et al. ..... 345/593
5,712,657 A 1/1998 Eglit et al.
5,986,640 A * 11/1999 Baldwin et al. ..... 345/596
6,040,876 A * 3/2000 Pettitt et al. ..... 348/624
6,052,491 A * 4/2000 Clatanoff et al. ..... 382/275
6,069,609 A * 5/2000 Ishida et al. ..... 345/596
6,144,354 A * 11/2000 Koyama et al. ..... 345/98
6,362,834 B2 * 3/2002 Ishii ..... 345/690
6,373,497 B1 * 4/2002 McKnight et al. ..... 345/602
6,414,657 B1 * 7/2002 Kasahara et al. ..... 345/63
6,469,708 B1 * 10/2002 Wu et al. ..... 345/596
6,496,194 B1 * 12/2002 Mikoshiba et al. ..... 345/596
6,674,444 B1 * 1/2004 Tahara ..... 345/589

OTHER PUBLICATIONS

Digital Video (Concepts and Applications Across Industries, by Theodore S. Rzeszewski p. 42–43.

* cited by examiner

*Primary Examiner*—Kee M. Tung
*Assistant Examiner*—Po-Wei Chen
(74) *Attorney, Agent, or Firm*—Joseph S. Tripoli; Harvey D. Fried; Christine Johnson

(57) ABSTRACT

A method (30) of reducing contouring in a liquid crystal on silicon (LCOS) display can include receiving a frame-doubled input signal (32) comprising a positive picture and a negative picture. A first dither (36) specified by a gamma table can be applied to the input signal. The first dither can selectively modify a primary-color gamma value of the negative picture or the positive picture. Also, a second dither (34) can be applied to the input signal at an input of the gamma table. The first and second dither can result in an output signal having reduced brightness level repetition for consecutive input levels.

17 Claims, 4 Drawing Sheets

| | A | B | C | D | E | F |
|---|---|---|---|---|---|---|
| Spread-sheet row | Input to table | Blue positive picture gamma table | Blue negative picture gamma table with no table dithering | Blue negative picture gamma table with table dithering | Blue equivalent average brightness relative to positive picture drive | Blue equivalent average brightness relative to positive picture drive with input dither added |
| 132 | 129 | 223 | 603 | 603 | 223.0 | 223.25 |
| 133 | 130 | 223 | 603 | 602 | 223.5 | 223.75 |
| 134 | 131 | 224 | 602 | 602 | 224.0 | 224.25 |
| 135 | 132 | 224 | 602 | 601 | 224.5 | 224.75 |
| 136 | 133 | 225 | 601 | 601 | 225.0 | 225.25 |
| 137 | 134 | 225 | 601 | 600 | 225.5 | 225.75 |
| 138 | 135 | 226 | 600 | 600 | 226.0 | 226.25 |
| 139 | 136 | 226 | 600 | 599 | 226.5 | 226.75 |
| 140 | 137 | 227 | 599 | 599 | 227.0 | 227.25 |
| 141 | 138 | 227 | 599 | 598 | 227.5 | 227.75 |
| 142 | 139 | 228 | 598 | 598 | 228.0 | 228.25 |
| 143 | 140 | 228 | 598 | 597 | 228.5 | 228.75 |
| 144 | 141 | 229 | 597 | 597 | 229.0 | 229.00 |
| 145 | 142 | 229 | 597 | 597 | 229.0 | 229.25 |
| 146 | 143 | 229 | 597 | 596 | 229.5 | 229.75 |
| 147 | 144 | 230 | 596 | 596 | 230.0 | 230.25 |
| 148 | 145 | 230 | 596 | 595 | 230.5 | 230.75 |
| 149 | 146 | 231 | 595 | 595 | 231.0 | 231.25 |
| 150 | 147 | 231 | 595 | 594 | 231.5 | 231.75 |
| 151 | 148 | 232 | 594 | 594 | 232.0 | 232.25 |
| 152 | 149 | 232 | 594 | 593 | 232.5 | 232.75 |

FIG. 1A

| | A | B | C | D | E | F |
|---|---|---|---|---|---|---|
| Spread-sheet row | Input to table | Blue positive picture gamma table | Blue negative picture gamma table with no table dithering | Blue negative picture gamma table with table dithering | Blue equivalent average brightness relative to positive picture drive | Blue equivalent average brightness relative to positive picture drive with input dither added |
| 153 | 150 | 233 | 593 | 593 | 233.0 | 233.00 |
| 154 | 151 | 233 | 593 | 593 | 233.0 | 233.25 |
| 155 | 152 | 233 | 593 | 592 | 233.5 | 233.50 |
| 156 | 153 | 233 | 593 | 592 | 233.5 | 233.75 |
| 157 | 154 | 234 | 592 | 592 | 234.0 | 234.25 |
| 158 | 155 | 234 | 592 | 591 | 234.5 | 234.75 |
| 159 | 156 | 235 | 591 | 591 | 235.0 | 235.25 |
| 160 | 157 | 235 | 591 | 590 | 235.5 | 235.75 |
| 161 | 158 | 236 | 590 | 590 | 236.0 | 236.00 |
| 162 | 159 | 236 | 590 | 590 | 236.0 | 236.25 |
| 163 | 160 | 236 | 590 | 589 | 236.5 | 236.75 |
| 164 | 161 | 237 | 589 | 589 | 237.0 | 237.25 |
| 165 | 162 | 237 | 589 | 588 | 237.5 | 237.75 |
| 166 | 163 | 238 | 588 | 588 | 238.0 | 238.25 |
| 167 | 164 | 238 | 588 | 587 | 238.5 | 238.75 |
| 168 | 165 | 239 | 587 | 587 | 239.0 | 239.25 |
| 169 | 166 | 239 | 587 | 586 | 239.5 | 239.75 |
| 170 | 167 | 240 | 586 | 586 | 240.0 | 240.00 |
| 171 | 168 | 240 | 586 | 586 | 240.0 | 240.25 |
| 172 | 169 | 240 | 586 | 585 | 240.5 | 240.50 |
| 173 | 170 | 240 | 586 | 585 | 240.5 | 240.75 |
| 174 | 171 | 241 | 585 | 585 | 241.0 | 241.25 |

FIG. 1B

REDUCTION OF GAMMA CORRECTION CONTOURING IN LIQUID CRYSTAL ON SILICON (LCOS) DISPLAYS

CROSS REFERENCE TO RELATED APPLICATIONS

This application claims the benefit of U.S. Provisional Patent Application No. 60/256,805, filed Dec. 20, 2000, in the United States Patent and Trademark Office.

BACKGROUND OF THE INVENTION

1. Technical Field

This invention relates to the field of projection television receivers utilizing liquid crystal on silicon (LCOS) technology in the light projection system, and more particularly, to a contour reduction method and system suited for an LCOS high definition television (HDTV) receiver.

2. Description of the Related Art

A light engine utilizing liquid crystal on silicon (LCOS) technology has a severe non-linearity in the display transfer function. This non-linearity can be corrected with a digital lookup table, referred to as a gamma table. The gamma table, however, has limited resolution, resulting in consecutive input values producing the same output values (repeated states) in low gradient portions of the table. Some of the repeated states are repeated three times, producing noticeable, undesirable contouring in the pictures made by the display.

LCOS technology is a recent development. In consequence, there is little prior art in the field. Generally, the brute-force solution has been employed to correct the non-linearity. Specifically, the brute-force solution has been to use a gamma table with enough resolution to accommodate the non-linearity. In some cases, for example, 10-bit values stored in the gamma table would have to be increased by two bits, from 10 bits up to 12 bits. The resolution of the table, however, is often under the control of the imager supplier. In consequence, the resolution of the table is not easily or quickly changed. There is a clear need for a method and/or apparatus to increase the resolution, or at least the apparent resolution, of such gamma tables without time consuming and costly design efforts.

SUMMARY OF THE INVENTION

The invention disclosed herein provides a method and system for improving the image quality attainable in a display utilizing liquid crystal on silicon (LCOS) technology. In accordance with the inventive arrangements, the strong non-linearity of the LCOS imaging transfer function can be corrected using a digital gamma table. Further, the contouring which is often produced from the use of a gamma table can be corrected using one or more dithers.

A first aspect of the present invention can include a method of reducing contouring in an LCOS display including receiving a frame-doubled input signal having a positive picture and a negative picture. A first dither can be applied to the input signal. The first dither, for example a table dither, can selectively modify a primary-color gamma value of one of the pictures resulting in reduced contouring in the input signal. Alternatively, in a second embodiment of the invention, the first dither can be a one-least-significant-bit dither signal which can be applied to the input signal.

A third aspect of the invention can include a method of reducing contouring in an LCOS display including receiving a frame-doubled input signal having a positive picture and a negative picture. A first dither can be applied to the input signal. The first dither, for example a table dither, can be specified by a gamma table and can selectively modify a primary-color gamma value of one of the pictures. A second dither can be applied to the input signal at an input of the gamma table. The second dither can be a one-least significant-bit dither signal applied to the input signal. The application of the first and second dithers can result in an output signal having reduced brightness level repetition for consecutive input levels.

Finally, the invention can include a multiple-dither system for reducing contouring in a display. The invention can include a memory having a gamma table stored therein. The gamma table can specify a first dither to apply to a received, frame-doubled input signal having a positive and a negative picture. The first dither can selectively modify at least one primary-color gamma value of one of the pictures. The system further can include a processor being communicatively linked to the memory. The processor can generate the gamma table and load the gamma table into the memory. A liquid crystal on silicon display also can be included for producing an image based upon the multiple-dithered input signal.

BRIEF DESCRIPTION OF THE DRAWINGS

There are shown in the drawings embodiments which are presently preferred, it being understood, however, that the invention is not so limited to the precise arrangements and instrumentalities shown.

FIGS. 1A and 1B, taken together, represent excerpts from exemplary gamma tables.

DETAILED DESCRIPTION OF THE PREFERRED EMBODIMENTS

Figure 2:
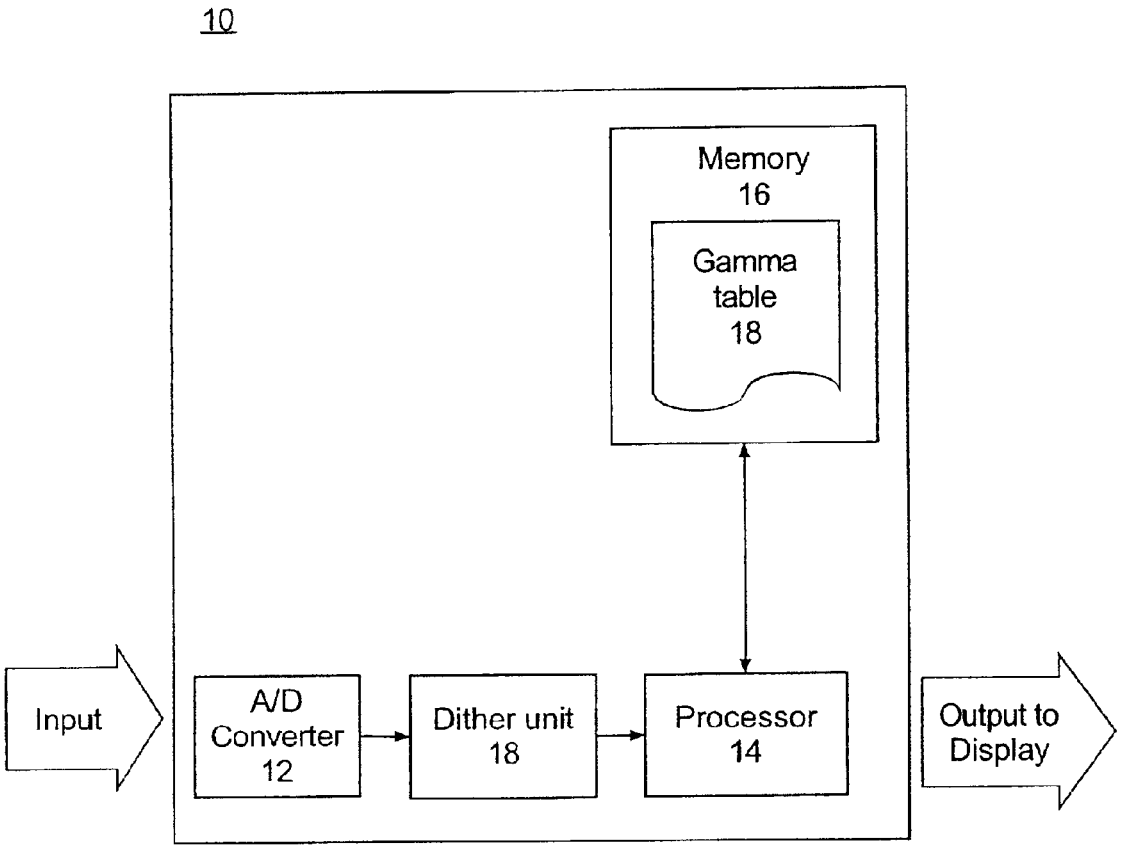
FIG. 2 is a block diagram illustrating an exemplary multiple-dither system in accordance with the present invention.

The invention disclosed herein provides a method and system for improving the image quality attainable in a display utilizing liquid crystal on silicon (LCOS) technology. In accordance with the inventive arrangements, the strong non-linearity of the LCOS imaging transfer function still can be corrected by using a digital gamma table. The response of the table, however, can be improved significantly by multiple dithering. The first dithering can change one or more primary color gamma values, for example, by a first dither. The primary color gamma values can be changed for a positive picture or a negative picture, wherein primary color as used herein can be the spectral primary colors of blue, green, and red. This first dither can provide some picture improvement with respect to contouring. Further substantial reductions in contouring can be achieved by a second dither applied to the signal at the input of the gamma table.

In an LCOS display, typically, the imager is driven with a frame-doubled signal by sending first a normal frame (positive picture) and then an inverted frame (negative picture) in response to a given input picture. The generation of positive and negative pictures ensures that each pixel will be written with a positive electric field followed by a negative electric field. The resulting drive field has a zero DC component, which is necessary to avoid image sticking, and ultimately, a permanent degradation of the imager. Insofar as contouring is perceived as a visible defect or artifact in the picture, it has been determined that the human eye responds to the average value of the brightness of the pixels produced by these positive and negative pictures.

The brightness versus the drive field of an LCOS imager produces a very nonlinear function which requires a compensating nonlinear drive signal. A digital lookup table called a gamma table can produce this nonlinear drive signal, even though the gamma table does not necessarily fit a gamma exponential curve. In one version of an imager drive system, a gamma table containing a positive picture portion and a negative picture portion is used. This is the type of gamma table described herein.

FIGS. 1A and 1B have been excerpted from a spreadsheet wherein the column headings A through F correspond to column headings of the spreadsheet and the first column having values 132 through 174 corresponds to the row numbers of the spreadsheet. Taken together, FIGS. 1A and 1B are a collection of columns representing in part different blue gamma tables for reducing contouring by generating a 10-bit output signal responsive to an 8-bit input signal. Gamma tables having a similar function can be used for red and green colors as well. As shown in FIGS. 1A and 1B, inputs values 129 through 171 are shown, whereas the entire table covers input values of 0 through 255.

In order to understand the table values of FIGS. 1A and 1B, an explanation of the specific LCOS system to which it refers is necessary. The drive voltages are supplied from plate electrodes on each side of the LCOS array. LCOS can be thought of as one large liquid crystal formed on a silicon die. The silicon die is divided into an incremental array of tiny plates. A tiny incremental region of the liquid crystal is influenced by the electric field generated by each tiny plate and the common plate. Each such tiny plate and corresponding liquid crystal region, taken together, can be referred to as a cell of the imager. Each cell corresponds to an individually controllable pixel. A common plate electrode is disposed on the other side of the liquid crystal. In the presently preferred LCOS system to which the gamma table pertains, the common plate is always at a potential of 8 volts. Each of the other plates in the array of tiny plates is operated in two voltage ranges. For positive pictures, the voltage can vary between 0 volts and 8 volts. For negative pictures, the voltage can vary between 8 volts and 16 volts.

Notably, the light supplied to the imager, and therefore supplied to each cell of the imager, is field polarized. Each liquid crystal cell can rotate the polarization of the input light responsive to the RMS value of the electric field applied to the cell by the plate electrodes. Interestingly, the cells are not responsive to the polarity, whether positive or negative, of the applied electric field. The brightness of each pixel's cell is a function of the rotation of the polarization of the light incident on the cell.

In this embodiment, in the case of either positive or negative pictures, as the field driving the cells approaches a zero field, corresponding to 8 volts, the closer each cell comes to white, which is full on. The input values can be supplied to the gamma table by an analog-to-digital (A/D) converter and can vary over many incremental steps. Other systems are possible, for example, where the common voltage is 0 volts. It will be appreciated that the inventive arrangements taught herein are applicable to all such positive and negative field LCOS imager driving systems. In any event, positive pictures can be defined as positive pictures when the voltage applied to the common plate electrode is greater than or equal to the greatest value in the range of the variable plate voltages in the array of the other electrode. Conversely, negative pictures can be defined as negative pictures when the voltage applied to the common plate electrode is less than or equal to the smallest value in the range of the variable plate voltages in the array of the other electrode.

As shown in FIGS. 1A and 1B, the exemplary gamma table can include six columns representing data and functionality as described herein. In fact, there are several alternative tables represented. The portion of the gamma table shown is from the lowest gradient portion of a blue table, where the contouring problem usually is most severe. In most cases, green contouring is worse than blue or red contouring. As previously mentioned, the first column, having values 132 through 174, corresponds to the row numbers of the spreadsheet from which the exemplary gamma table was excerpted. Column A includes inputs to the gamma table. Columns B and C represent prior art gamma correction values. In each of columns B and C, the brightness increases going down each column. Column D represents gamma correction values resulting from a single dither applied to the values of column C. This single dither can be referred to as a table dither. Column E represents equivalent average brightness that would be produced by a positive only gamma table if the positive and negative tables are implemented as in columns B and D respectively. Column F represents equivalent average brightness values similar to column E, with the noted exception that a second dither has been applied to the input signal. This second dither can be referred to as an input dither, to distinguish it from the table dither. Taken together, the table dither and the input dither are a multiple dither.

When a positive picture is being generated, the output values can come from column B. When a negative picture is being generated, the output values can come from the negative table, two possible versions of which are shown in columns C and D. The gamma table is created such that a negative table value will produce approximately the same light intensity as a positive table value. The portion of the gamma table shown in FIGS. 1A and 1B is from the lowest gradient portion of a blue table where the contouring problem usually is most severe. The conventional practice of the prior art would use column B for positive pictures and column C for negative pictures. As can be seen from the FIGS. 1A and 1B, there are several places in the table in which successive input values produce the same pair of positive and negative output values. For example, input values 150, 151, 152, and 153 (corresponding to spreadsheet row numbers 153–156 respectively) produce a positive picture output value of 233 in column B and a negative picture output value of 593 in column C. Repeated values such as this usually produce visible contouring in a resulting picture. The alternative negative picture gamma table shown in column D is based upon a dither of the values in column C. It can be seen that fewer values are repeated in column D than for column C. For example, prior to application of the first dither, the input values of 150, 151, 152, and 153 resulted in a repeated gamma value of 593 as shown in column C. After application of the first dither, however, only the input values of 149, 150, and 151 resulted in a repeated gamma value of 593 as shown in column D. Thus, the repetition was decreased by one.

As an example of a presently preferred table dither, the following equation executed within a spreadsheet, such as Microsoft Excel, manufactured by Microsoft Corporation of Redmond, Wash., was used to calculate the column D gamma correction value for the input value of 152:

=IF(AND(B154=B155,B153=B155),C155−1,
IF(AND(B155=B154,B155=B156,B155< >B153),C155,
IF(B155=B154,C155−1,C155))).

The above expression refers to cells of the spreadsheet. As such, the expression references cell locations using the column headings A through F in combination with the cell row numbers of the spreadsheet derived from the first column of FIGS. 1A and 1B. The above equation can be used to apply a dither to a gamma table with preferably less than 5 repeated picture values.

The perceived brightness of a scene region is determined by the average of the positive picture brightness and the negative picture brightness. Column E shows the average effect of the positive picture and the negative picture for that input value, relative to the positive table value when using the values of column B and column D. Notably, the input values 150 through 153 produce two different average brightness levels, as shown in column E, resulting in a reduction of contouring. It can be seen in column E, however, that not all of the repetitions of brightness levels for consecutive inputs have been eliminated.

The results of the first dither, using the values of column D, can be demonstrated by the following examples. When the input signal to the gamma table is 142, without the further dither of the input signal, the result in column E is the average of the corresponding values in columns B and D, which are 229 and 597. It must be remembered that the values in the two columns are equal to one another in brightness, so that for purposes of the calculations, the 597 value is equal to the 229 value. The average of 229 and 229 is 229 as shown in column E. When the input signal to the gamma table is 143, without the further dither of the input signal, the result in column E is the average of the corresponding values in columns B and D, which are 229 and 596 respectively. For purposes of the calculations, the 596 value is equal to the 230 value. The average of 229 and 230 is 229.5 as shown in column E. As can be seen, it is necessary to modify only one of the sets of positive and negative picture values, not both. Consequently, another embodiment of the invention can include application of the table dither to the positive gamma values, rather than the negative gamma values.

In order to eliminate all, or at least virtually all, of the repeated brightness levels in accordance with the inventive arrangements, a further dither signal can be added to the input signal. For example, a one-least-significant-bit dither can be added to an 8-bit input signal. This dither can be alternately low and high, pixel by pixel. The phase of the dither also can invert each line, forming a quincunx pattern. Such a pattern can have low visibility. Inverting the quincunx pattern for each input picture can reduce the visibility of the input dither pattern in the picture. A 4-state or an 8-state dither can be used in accordance with the inventive arrangements, instead of a 2-state dither as explained above. Such higher state dithers, however, can be progressively harder to hide in the picture.

In order to examine the overall effect of both measures on contouring, that is, the effect of the multiple dither, it is necessary to average together the gamma outputs of the positive and negative pictures and the outputs of the table for the high and low values of the input dither. This averaging is shown in column F. The examples are explained below.

The effect of the input dither, a 2-state dither in the presently preferred embodiment, is to have the input signal vacillate between two adjacent table input signals with a 50% duty cycle. This results in an average brightness of four table output values rather than just two table output values, as demonstrated by the following examples. Assume the input value is 142. The further dither of the input signal will result in an effective input value that is equal to 142 half of the time that 142 is applied as an input, and equal to 143 the other half of the time that 142 is applied as an input. When the effective input is 142, the gamma values are 229 and 597 (597 being equal to 229). When the effective input is 143, the gamma values are 229 and 596 (596 being equal to 230). The average of 229, 229, 229 and 230 is 229.25 as shown in column F. Assume the input value is 143. The further dither of the input signal will result in an effective input value that is equal to 143 half of the time that 143 is applied as an input, and equal to 144 the other half of the time that 143 is applied as an input. When the effective input is 143, the gamma values are 229 and 596 (596 being equal to 230). When the effective input is 144, the gamma values are 230 and 596 (596 being equal to 230). The average of 229, 230, 230 and 230 is 229.75 as shown in column F.

It will be appreciated that the actual gamma table would need to include only columns A, B, and D to be operational. Column C would be useful only if the column C values were changeable during service, and the column D values needed to be recalculated; assuming the microprocessor in the receiver were programmed to perform this function. It is the table dithering that produces the values in column D and the input dithering that achieves the results demonstrated by column F. The values of column F will be the operational result and need not be in the table itself.

As shown in column F, for each incremental step in the input value there is a change in the equivalent average brightness when multiple dithering is employed in accordance with the inventive arrangements. The absence of repeating values in the equivalent average brightness precludes, or at least substantially precludes contouring. It should be noted that it is possible that in a particular imager system, a small number of the gamma values for the least bright input values can be constant. In that case, the equivalent average brightness may not change even with multiple dithering. Even if contouring results at these least bright levels, the entire picture typically is too dim to see with or without contouring. Thus, for all practical purposes, the inventive arrangements eliminate, or substantially reduce, visible contouring in the picture.

FIG. 2 is a block diagram illustrating an exemplary multiple-dither system 10 in accordance with the present invention. As shown in FIG. 2, the multiple-dither system 10 can include an optional A/D converter 12, a dither unit 18, a processor 14, and a memory unit 16. Each of the aforementioned components can be communicatively linked, for example through a communications bus, as is known in the art.

In one embodiment of the invention, the optional A/D converter 12 can be included to digitize a received analog signal. For example, the A/D converter 12 can process a received frame-doubled input signal including a positive picture and a negative picture. The received analog signal can be transformed into a digital signal suitably formatted for processing by the dither unit 18 and/or the processor 14. It should be appreciated, however, that the invention disclosed herein can be utilized within an entirely digital environment. In that case, a digital input can be received, in which case the A/D converter 12 need not be included.

Regardless, a digitized input signal can be provided to the dither unit 18. As shown in FIG. 2, the dither unit 18 can apply a one-least-significant-bit dither to the input signal prior to providing the signal to processor 14. The dithered signal then can be provided to processor 14. Processor 14 can be any variety of processors such as a specialized digital signal processor or a more general microprocessor, each of which is known in the art. The processor 14 can apply a table dither to the received signal. More specifically, the processor 14 can access memory 16, which can be a volatile or non-volatile memory having instructions, algorithms, and/or a gamma table 18 stored therein. With reference to memory 16, processor 14 can apply a table dither to the received signal. This table dither can selectively modify a primary color gamma value of the positive or negative picture. The resulting signal, having been subjected to multiple dithers, can be provided to an LCOS display.

Figure 3:
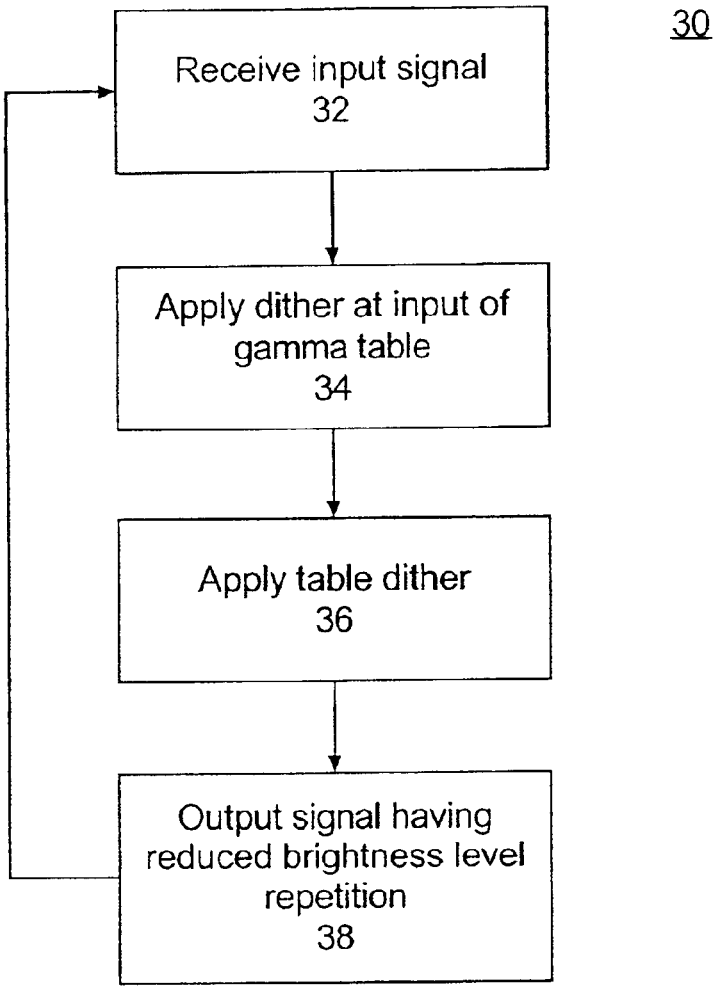
FIG. 3 is a flow chart illustrating an exemplary method of reducing contouring in accordance with the present invention.

FIG. 3 is a flow chart illustrating an exemplary method 30 of reducing contouring in accordance with the present invention. The method can begin in step 32 where an input signal can be received. As previously mentioned, the input signal can be a digital representation of a frame-doubled signal having a positive and a negative picture.

In step 34, a dither can be applied to the received input signal at the input of the gamma table. For example, a one-least-significant-bit dither signal can be applied to the input signal. After completion of step 34, the method can continue to step 36. In step 36, a table dither can be applied to the input signal. For example, the table dither can be implemented using digital signal processing algorithms known in the art which can implement the table dither as described herein. Alternatively, as mentioned, the table dither can be implemented using a look-up table such as the gamma table disclosed herein. In any case, in step 36, as a result of the application of the table dither, a gamma value of the input signal can be modified. Notably, this can produce a reduction of contouring in the resulting output. After step 36, the method can continue to step 38.

In step 38, an output signal can be provided having reduced brightness level repetition. The output signal can be provided, for example, to an LCOS display. After completion of step 38, the method can be repeated as necessary to process further received signals. From step 38, the method can loop back to step 32 to process subsequently received input signals.

The invention disclosed herein can be embodied in other specific forms without departing from the spirit or essential attributes thereof, and accordingly, reference should be had to the following claims, rather than to the foregoing specification, as indicating the scope of the invention.

I claim:

1. A method of reducing contouring in a liquid crystal on silicon (LCOS) display comprising individually controllable pixels, the display including at least one gamma correction table having a corresponding table resolution, the method comprising the steps of:

providing an input signal comprising successive pictures to be displayed on said display;

applying a first set of gamma correction values to a first picture portion of each of said successive pictures to provide corresponding gamma corrected first picture portions for each successive picture;

applying a second set of gamma correction values to a second picture portion of each of said successive pictures to provide corresponding gamma corrected second picture portions for each picture;

combining said gamma corrected first picture portion with said gamma corrected second picture portion to provide a picture comprising pixels having brightness levels determined by the combined picture portions;

reducing the number of said pixels having repeated brightness levels in successive pictures without changing said table resolution by applying steps of table dithering and input dithering.

2. The method of claim 1 wherein the reducing step is carried out by applying a dither to said input signal.

3. The method of claim 2, wherein the dithering step results in a picture having a quincunx dither pattern.

4. The method of claim 3 wherein said quincunx dither pattern in said picture is alternately inverted and not inverted.

5. The method of claim 1 wherein the reducing step is carried out by applying a dither to one of said first and second sets of gamma correction values.

6. The method of claim 1 wherein the reducing step is carried out by the steps of:

applying a dither to said input signal; and applying a dither to one of said first and second sets of gamma correction values.

7. The method of claim 1 wherein further comprising the steps of:

providing reference gamma correction values; and modifying said reference values to provide said first set of gamma correction values.

8. The method of claim 7 wherein said the modifying step is carried out by a step of changing least significant bits of said reference gamma correction values to provide said first set of gamma correction values.

9. The method of claim 1 wherein said first picture portion is a positive picture portion and said second picture portion is a negative picture portion.

10. The method of claim 1 wherein said second picture portion is a positive picture portion and said first picture portion is a negative picture portion.

11. The method of claim 1 wherein said at least one gamma correction table is a primary color gamma correction table.

12. The method of claim 11 wherein said primary color is selected from the group comprising reds green and blue.

13. The method of claim 1 wherein said input signal is an 8-bit signal and said gamma correction table has a resolution of 10 bits.

14. The system of claim 13 wherein said gamma correction unit comprises a primary color gamma correction table, said primary color selected from the group comprising red, green and blue.

15. A system for reducing contouring caused by repeated displayed pixel brightness levels in a liquid crystal on silicon (LCOS) display, the system comprising:

a receiver for receiving an input signal comprising successive pictures, each of said successive pictures having a corresponding intended brightness level for each pixel;

a display for displaying each of said successive pictures with a displayed pixel brightness level for each pixel;

a system for transferring each of said pictures from said receiver to said display such that said displayed brightness levels of said pixels approximately matches said intended brightness levels of said pixels for each successive picture;

said system characterized by a transfer function relating said displayed pixel brightness levels to said intended pixel brightness levels, said transfer function including an imager gamma;

said system including an imager coupled to a gamma correction unit to cause said imager to operate in accordance with a gamma corrected transfer function;

said gamma corrected transfer function having associated therewith a number of repeated displayed brightness levels corresponding to different intended brightness levels;

a dithering unit applying at least a table dither and an input dither to reduce the number of said repeated displayed pixel brightness levels corresponding to different intended pixel brightness levels.

16. The system of claim 15 wherein each of said successive pictures comprises a positive picture portion and a negative picture portion and wherein said gamma correction unit applies a first gamma correction to said positive portion and a second gamma correction to said negative picture portion wherein said first gamma correction differs from said second gamma correction so as to reduce the number of repeated displayed pixel brightness levels associated with said gamma corrected transfer function.

17. The system of claim 15 wherein said dithering unit is coupled to said receiver and to said gamma correction unit to apply a first dither to said input signal so as to reduce the number of repeated displayed pixel brightness levels associated with said gamma corrected transfer function.

* * * * *